United States Patent [19]

Arai

[11] Patent Number: 4,839,783

[45] Date of Patent: Jun. 13, 1989

[54] LIGHTING APPARATUS

[76] Inventor: Akira Arai, 32-7, Soshigaya 1-chome, Setagaya-ku, Tokyo, Japan

[21] Appl. No.: 163,287

[22] Filed: Mar. 2, 1988

[30] Foreign Application Priority Data

Mar. 2, 1987 [JP] Japan ..... 62-47395

[51] Int. Cl.[4] ..... F21V 29/00

[52] U.S. Cl. ..... 362/374; 362/294; 362/362; 362/373; 362/375

[58] Field of Search ..... 362/294, 268, 362, 371, 362/372, 374, 375, 373, 199

[56] References Cited

U.S. PATENT DOCUMENTS 3,755,665 8/1973 Grindle ..... 362/375 X 4,642,742 2/1987 de Vos et al. ..... 362/375

*Primary Examiner*—Stephen F. Husar

*Attorney, Agent, or Firm*—Birch, Stewart, Kolasch & Birch

[57] ABSTRACT

A lighting apparatus has a casing pivotally separable along an intermediate parting line so as to facilitate various operations such as assembly, replacement, repair and checking of components contained therein. These components can be a light source, a projector lens, a variable masking device and a cooling fan, for example. Additionally, displaceable pivots are provided along the parting line for pulling a pivotal mechanism into the casing as respective casing halves are coupled to each other. The pivots can be displaced as the casing is opened and closed so that not only the opening and closing operation can be smoothly performed but also the external appearance of the apparatus is never injured since the pivotal mechanism is not exposed and no gap is developed along the parting line upon completely coupling the casing halves. Furthermore, the pivots are displaceable against the tensile force of tension spring members and, after the casing halves have been coupled to each other, the pivotal mechanism is held by the tension spring members within the casing to assure a simplified structure and a reliable coupling effect.

6 Claims, 4 Drawing Sheets

LIGHTING APPARATUS

BACKGROUND OF THE INVENTION

The present invention relates to a lighting apparatus such as a spot light.

The lighting apparatus such as the spot light is well known, in which the casing is partially provided with the cover adapted to be opened and closed for replacement of the internal components, for example, the light source. However, it is unknown to make the casing separable along an intermediate parting line so that various operations such as repair, checking and replacement of the components contained therein, for example, the projector lens, the light source and the variable masking plate may be facilitated.

In the prior art lighting apparatus, the casing has the above-mentioned cover at an inconspicuous position often in the wall remote from the projector lens and, therefore, the pivotal mechanism around which said cover is opened and closed, even if such pivotal mechanism is exposed on the exterior of the casing, would not injure the appearance of the apparatus, although said components contained within the casing are not easily accessible, for example, for repair thereof. It has been attempted to facilitate said operations by dividing the casing into the casing halves adapted to be pivotally coupled, but the pivotal mechanism has been inevitably exposed along the intermediate parting line of the casing, injuring the external appearance of the apparatus. To construct the casing so that the casing halves may be opened and closed relative to each other by means of the pivotal mechanism disposed within the casing, the casing must be provided along the parting line thereof with a certain width of relief for smooth opening and closing and this necessarily develops an undesirable gap along the parting line.

SUMMARY OF THE INVENTION

To eliminate the problem as has been set forth above, the present invention provides a lighting apparatus having a casing pivotally separable along an intermediate parting line, characterized by pivots provided along said parting line which are so displaceable that an entire pivotal mechanism is received into the casing after the casing halves have been coupled to each other. The present invention further provides a lighting apparatus having a casing pivotally separable along an intermediate parting line, characterized by pivots provided along said parting line which are so displaceable against a spring force that an entire pivotal mechanism is received into the casing after the casing halves have been coupled to each other.

Conveniently, the lighting apparatus constructed in accordance with the present invention has a casing pivotally separable along an intermediate parting line so as to facilitate various operations such as assembly, replacement, repair and checking of components contained therein, for example, a light source, a projector lens, a variable masking device and a cooling fan. Additionally, displaceable pivots are provided along the parting line for pulling a pivotal mechanism into the casing as respective casing halves are coupled to each other in a snug-fit manner. This construction feature allows the pivots to be displaced as the casing is opened and closed so that not only the opening and closing operation can be smoothly performed but also the external appearance of the apparatus is never injured since the pivotal mechanism is not exposed and no gap is developed along the parting line upon completely coupling the casing halves. Furthermore, the unique construction such that the pivots are displaceable against the tensile force of the tension spring members and, once the casing halves have been coupled to each other, the pivotal mechanism is held by the tension spring members within the casing is also very advantageous particularly to assure a simplified structure and a reliable coupling effect.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus, are not limitative of the present invention, and wherein.

DESCRIPTION OF EMBODIMENTS

Figure 2:
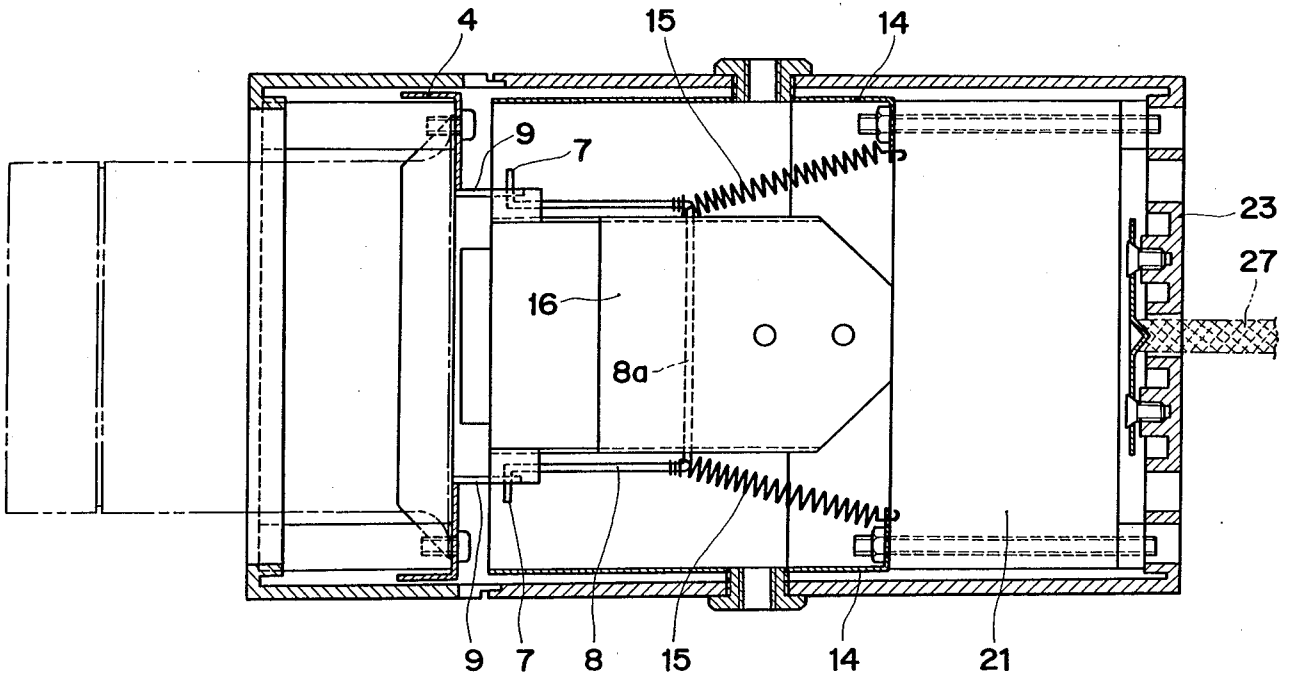
FIG. 2 is a schematic plan view showing said important part.
Figure 3:
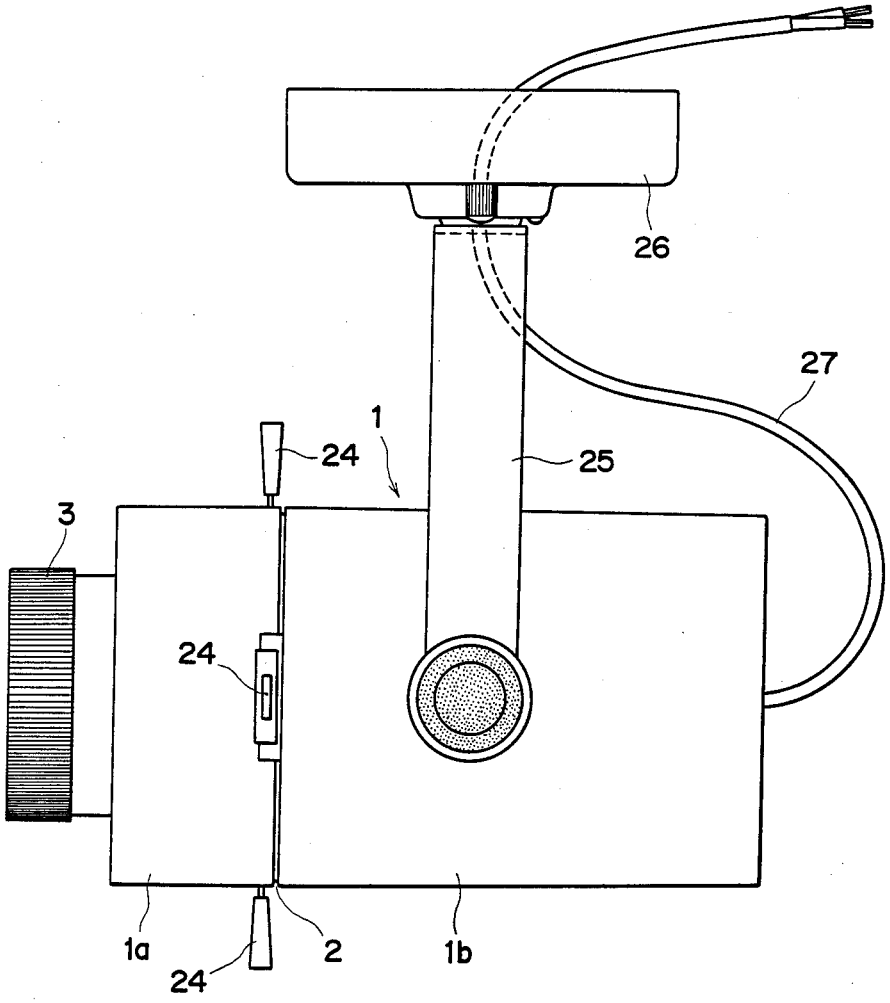
FIG. 3 is a side view illustrating a manner in which the apparatus is operated.
Figure 4:
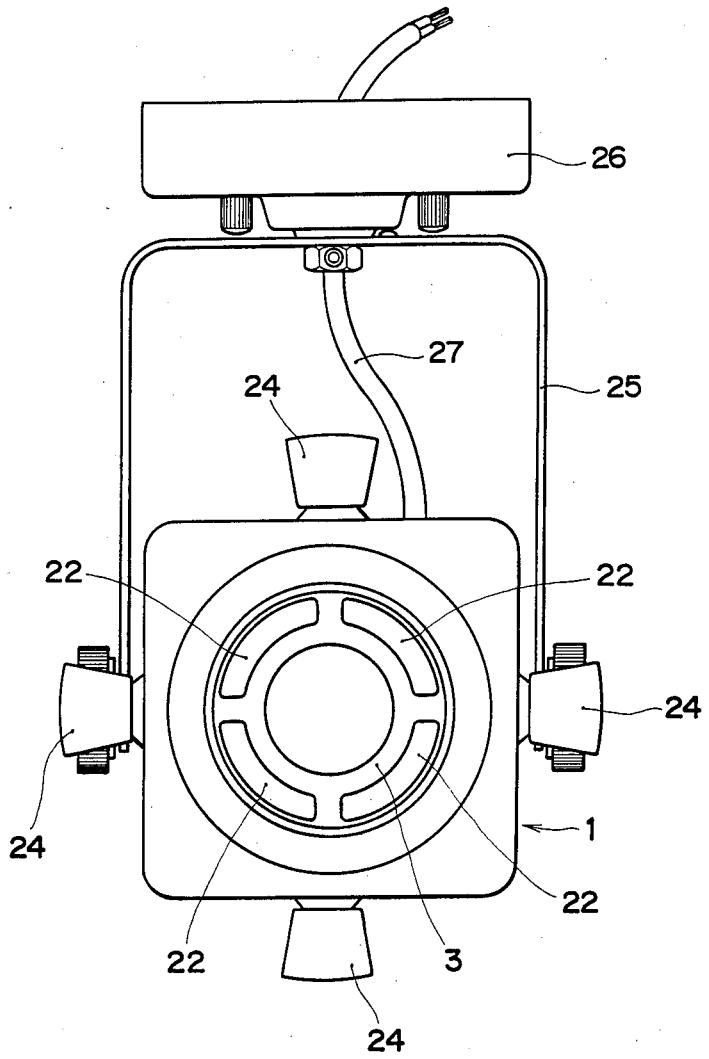
FIG. 4 is a front view similarly illustrating the manner of operation.

The present invention will be readily apparent from the following description of an exemplary embodiment to be understood in conjunction with the accompanying drawing. Reference numeral 1 designates a casing presenting a rectangular cross-section, comprising a front casing 1*a* and a rear casing 1*b* adapted to be snug-fit to each other along a parting line 2. A zoom projector lens 3 is mounted in the front casing 1*a* by a mounting plate 4 which has, in turn, a variable masking device 5 and a lamp holder 6 integrally mounted thereon. Reference numeral 7 designates pivots disposed along the inner wall of the rear casing 1*b*, which comprise, in this embodiment, opposite ends of a square U-shaped wire frame 8 each bent so as to project outwards, as best seen in FIG. 2. The pivots 7 are disengageably engaged into associated pivot frames 9 extending rearwards from said mounting plate 4 of the front casing 1*a*. The rear casing 1*b* contains therein a latch lever 10 mounted on a section of its inner wall that is remote from and opposed to the pivots 7 and a locking lever 11 extending from a projecting frame 6*a* of said lamp holder 6. The locking lever 11 is normally spring-biased to be engaged with the latch lever 10. Reference numeral 12 designates a release button for the locking lever 11, which is carried by a leaf spring 13 on its free end so as to be exposed from the casing. Said release button 12 may be depressed to disengage the locking lever 11 from the latch lever 10. A pair of tension spring members 15 each stretched between a bridge portion 8*a* of said wire frame 8 that extends in parallel to the pivots 7 and associated stationary frames 14 of the rear casing 1*b* exert a tensile force on the respective pivots 7. Reference numeral 16 designates a guide plate serving to guide said bridge portion 8*a* during movement of the pivots 7. Reference numeral 17 designates a light source such as a halogen lamp with a cold mirror which is removably mounted on the lamp holder 6 by means of a supporting frame 6*b* forming a part of said lamp holder 6 and a retainer spring 18 extending from said projecting frame 6*a*. Terminals of the light source 17 are disconnectably connected to a socket 20 which is, in turn, connected by a cable to a terminal block 19. Reference numeral 21 designates a cooling fan enclosed by a rear end portion of the rear casing 1*b*, which is adapted to circulate fresh air taken through a rear casing frame 23 around the light source 17 and then to discharge the air through ventilating holes 22 formed around the base of the lens 3. Reference numeral 24 designates manipulating knobs projecting from four sides of the casing 1 for framing of said variable masking device 5. By sliding these knobs 24 back and forth, in combination with a rotating operation thereof if necessary, it is possible to define a desired contour of the projected light. Reference numeral 25 designates a support member adapted for tiltably supporting the casing 1, reference numeral 26 designates a mount by which the apparatus may be installed on a ceiling, wall etc, and finally reference numeral 27 designates a cable for power supply.

Figure 1:
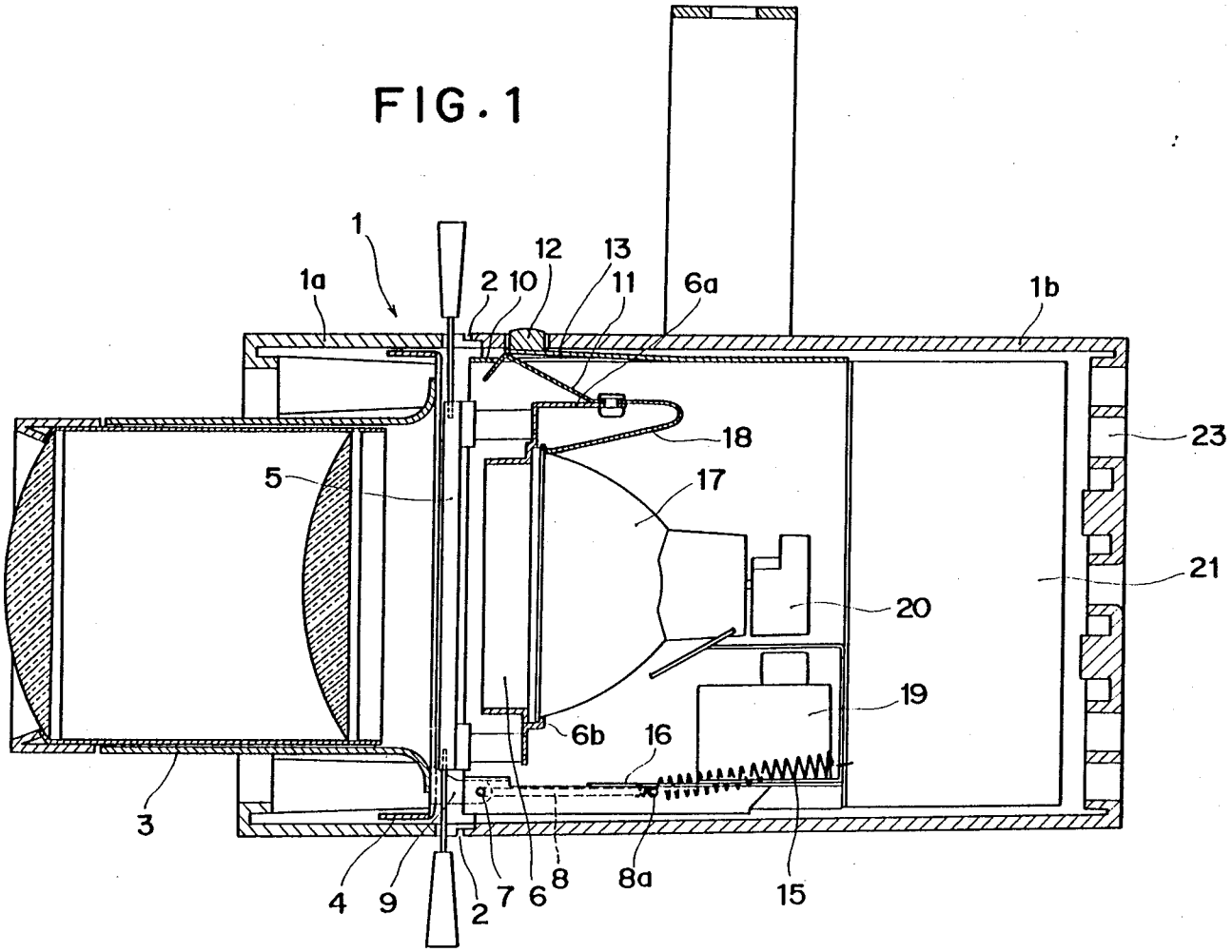
FIG. 1 is a sectional side view showing an important part in one embodiment of the apparatus constructed in accordance with the present invention.

When the aforementioned arrangement is in the state of FIG. 1, the front casing 1*a* and the rear casing 1*b* are coupled integrally to each other along the parting line 2 with both the pivots 7 and the pivot frames 9 being enclosed within the casing 1 so that the external appearance of the apparatus is never injured. From this state, the release button 12 may be depressed to disengage the locking lever 11 from the latch lever 10 and thereby to open the front casing 1*a* relative to the rear casing 1*b* around the pivots 7. Rotation of the pivot frames 9 forcibly pulls the pivots 7 out of the rear casing 1*b* against the tensile force of the tension spring members 15. Thus, the projector lens 3, the variable masking device 5 and the light source 17 are also swung out integrally with the front casing 1*a* relative to the rear casing 1*b* so that these components become accessible. After the front casing 1*a* has been completely opened, the pivots frames 9 may be disengaged from the respective pivots 7 to perform repairing, checking and replacing operation for the projector lens, the light source etc. It is also easily possible to perform such operation for the components contained within the rear casing 1*b* such as the socket and the cooling fan.

Now the pivot frames 9 may be brought back into engagement with the associated pivots 7 and the front casing 1*a* may be rotated towards the rear casing 1*b* as the pivots 7 are displaced to snug-fit these casings 1*a* and 1*b* to each other. Such snug-fitting is smoothly accomplished and this state is reliably maintained by the tensile force of the tension spring members 15.

As will be readily understood from the foregoing description, the present invention provides for the lighting apparatus to have a casing which is pivotally separable along the intermediate parting line to facilitate various operations such as assembly, replacement, repair and checking of the components contained therein, for example, the light source, the projector lens, the variable masking device and the cooling fan. Additionally, the pivots disposed along the parting line is displaceable so as to pull the pivotal mechanism into the casing as the front and rear casings are coupled to each other. This construction feature allows the pivots to be displaced as the casing is opened and closed so that not only the opening and closing operation can be smoothly performed but also the external appearance of the apparatus is never injured since the pivotal mechanism is not exposed and no gap is developed along said parting line upon coupling of the casing halves. Furthermore, the unique construction that the pivots are displaceable against the tensile force of the tension spring members and, after the casing halves have been coupled to each other, the pivotal mechanism is held by said tension spring members within the casing is also very advantageous in practical use, particularly to assure a simplified structure and a reliable coupling effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lighting apparatus comprising:

a casing having two halves, said halves being separable along an intermediate parting line;

means for pivoting said two halves relative to one another to open and close said casing, said means for pivoting being laterally displaceable relative to said casing; and means for urging said means for pivoting to a position within said casing for placing said means for pivoting inside said casing when said halves are closed.

2. The lighting apparatus as recited in claim 1, wherein one of the halves of the casing contains a projector lens, a variable masking plate, a mirror and a light source and the other half of the casing contains a cooling fan.

3. The lighting apparatus as recited in claim 1, wherein said means for pivoting comprises a generally U-shaped member having two ends, each of said ends having a projection attached to one of the halves of the casing.

4. The lighting apparatus as recited in claim 3, wherein said means for urging comprises springs extending from the U-shaped member to a frame member attached to the other half of said casing.

5. The lighting apparatus as recited in claim 1, further comprising locking means for holding said halves of the casing closed and release means for releasing the locking means to permit said halves to be opened.

6. A lighting apparatus comprising:

a casing having two halves, said halves being separable along an intermediate parting line, one of the halves containing a projector lens, a variable masking plate, a mirror and a light source and another half of the casing containing a cooling fan; and means for pivoting said two halves relative to one another to open and close said casing, said means for pivoting being laterally displaceable relative to said casing.

* * * * *